US005140953A

United States Patent [19]

Fogelberg

[11] Patent Number: 5,140,953

[45] Date of Patent: Aug. 25, 1992

[54] DUAL DISPLACEMENT AND EXPANSION CHARGE LIMITED REGENERATIVE CAM ENGINE

[76] Inventor: Henrik C. Fogelberg, 80 137th Ave. Cir., Madeira Beach, Fla. 33708

[21] Appl. No.: 641,188

[22] Filed: Jan. 15, 1991

[51] Int. Cl.[5] ..... F02B 75/26; F02B 69/06; F01L 9/04

[52] U.S. Cl. ..... 123/58 A; 123/311; 123/21; 123/90.12

[58] Field of Search ..... 123/90.12, 90.31, 90.32, 123/90.15, 90.16, 90.55, 21, 58 A, 58 AA, 58 AB, 48 R, 198 F, 64, 311, 90.59, 78, 316

[56] References Cited

U.S. PATENT DOCUMENTS

| | | | |
|---|---|---|---|
| 1,181,463 | 5/1916 | La Fontaine | 123/58 A |
| 1,810,017 | 6/1931 | Houston | 123/58 A |
| 3,356,080 | 12/1967 | Howard | 123/48 R |
| 3,673,991 | 7/1972 | Winn | 123/58 A |
| 4,149,498 | 4/1979 | Ferrell | 123/58 AA |
| 4,153,016 | 5/1979 | Hausknecht | 123/90.12 |
| 4,168,632 | 9/1979 | Fokker | 123/48 R |
| 4,258,671 | 3/1981 | Takizawa et al. | 123/90.16 |
| 4,280,451 | 7/1981 | Moore | 123/90.6 |
| 4,401,069 | 8/1983 | Foley | 123/90.32 |
| 4,466,390 | 8/1984 | Babitzka et al. | 123/90.16 |
| 4,492,188 | 1/1985 | Palmer et al. | 123/58 A |
| 4,494,495 | 1/1985 | Nakamura et al. | 123/90.15 |
| 4,502,425 | 3/1985 | Wride | 123/90.12 |
| 4,509,467 | 4/1985 | Arai et al. | 123/90.57 |
| 4,510,894 | 4/1985 | Williams | 123/48 R |
| 4,523,550 | 6/1985 | Matsuura | 123/90.12 |
| 4,553,508 | 11/1985 | Stinebaugh | 123/58 AA |
| 4,583,501 | 4/1986 | Williams | 123/90.31 |
| 4,696,265 | 9/1987 | Nohira | 123/90.16 |
| 4,723,517 | 2/1988 | Frost | 123/90.31 |
| 4,736,715 | 4/1988 | Larsen | 123/64 |
| 4,765,288 | 8/1988 | Linder et al. | 123/90.16 |
| 4,781,155 | 11/1988 | Bruckner | 123/70 V |
| 4,858,572 | 8/1989 | Shirai et al. | 123/90.12 |
| 4,873,949 | 10/1989 | Fujiyoshi et al. | 123/90.31 |
| 4,889,085 | 12/1989 | Yagi et al. | 123/90.12 |
| 4,892,067 | 1/1990 | Paul et al. | 123/90.12 |
| 4,898,128 | 2/1990 | Meneely | 123/90.12 |
| 4,903,650 | 2/1990 | Ohlendorf et al. | 123/90.31 |
| 4,934,348 | 6/1990 | Yagi et al. | 123/90.16 |
| 4,942,853 | 7/1990 | Konno | 123/90.16 |
| 4,955,330 | 4/1991 | Fabi et al. | 123/90.31 |
| 4,974,555 | 12/1991 | Hoogenboom | 123/58 A |

FOREIGN PATENT DOCUMENTS 1001049 1/1957 Fed. Rep. of Germany .

OTHER PUBLICATIONS

Supercharging of IC Engines by K. Zinner pp. 205–212, Jan. 1978.

Test Report—Florence-Darlington Tech. Coll. by D. Miles, Mar. 1983, 4 pages.

*Primary Examiner*—David A. Okonsky

*Assistant Examiner*—Thomas N. Moulis

[57] ABSTRACT

A combination, in a supercharged expansible chamber engine having at least one cam driven piston, of a piston drive cam profile that alternately drives the piston to a higher or lower top dead center TDC position producing different expansion ratios, of a valve cam drive arrangement that shifts firing position between the two TDC positions selecting an expansion ratio, of a continously variable charge volume limiting system that controls the charge by controlling intake valve open duration eliminating throttling losses, of a control system that limits the maximum charge volume or intake displacement in accordance with the firing TDC and the supercharged pressure thereby avoiding pre-ignition firing and allowing supercharger compression to replace cylinder compression instead of adding to it, comprising:

a piston drive cam (18) with two TDC positions that differ in height;

a planetarily mounted bevel gear (68) whose position is rotated to change the angular relationship of valve cam (58) to main drive shaft (54);

a cam driven hydraulically operated valve system that allows intake valve (48) to close, when cam follower (24) is driven by valve cam (58) to the continously adjustable position of release controller (36) where, follower annulus (26) overlaps controller annulus (30) and the fluid supporting valve lifter (50) is released;

a control system (164) that limits the maximum open duration of intake valve (48) in accordance with the selected TDC, supercharged pressure and accelerator demand.

21 Claims, 6 Drawing Sheets 1400
1300
1200
R°
THROTTLED
INVENTION
TPI
LIMITED
50
40
%
INVENTION
SHIFT LIMITED
SPEED THROT.
LIMITED
ITE
THROTTLED
300
200
100
PSIA
THROTTLED
INVENTION
PPI
LIMITED
RPI
20
15
10
5
0
20
IDLE
40
60
80
100
% IMEP

SECTION A-A
FROM FIG. 8

DUAL DISPLACEMENT AND EXPANSION CHARGE LIMITED REGENERATIVE CAM ENGINE

BACKGROUND

1. Field of Invention

This invention relates to a an expansible chamber engine with cam driven pistons, such as an internal combustion engine, that during operation can change expansion ratios and intake displacements and appropriately limit the fuel air charge, specifically to an arrangement that shifts combustion peaks between, differing in height, top dead center positions on a four stroke piston drive cam, by shifting the valve and combustion timing and, limits the charge to prevent pre-ignition firing that would be caused by the shift, by controlling the open duration of the intake valve. And, limits the maximum charge volume so the work used to supercharge replaces cylinder compression.

2. Description of Prior Art

Increasing the fuel efficiency or decreasing the specific fuel consumption, SFC, in commercially acceptable spark ignition engines has heretofore been restricted in many ways:

(a) Limiting is defined for this invention as the process of controlling the unthrottled fuel air charge into a cylinder by variably closing the intake valve early. The advantages for an engine with one stage of limiting is discussed in U.S. Pat. No. 4,280,451. The compression ratio, cylinder to clearance volume, was apparently increased by shaving the heads to reduce the clearance volume, but the effective cylinder intake volume was also reduced by early valve closure on the intake stroke. The resulting compression ratio, herein called the limited compression ratio, is based on the reduced effective intake volume and, is still limited by pre-ignition firing to the same maximum as before. The volumetric efficiency is decreased since only part of the cylinder volume can be filled with fuel air charge. A larger engine is required to produce the same maximum power.

(b) Decreasing SFC by increasing the expansion ratio is restricted by the mechanical complexity required. Current commercial designs offer only fixed and equal expansion and compression ratios.

(c) The primary means of controlling engine output currently is throttling, which restricts lowering SFC due to the inherent throttling losses.

(d) Decreasing SFC by increasing the compression ratio, or more relevantly the pre-ignition pressure to atmospheric pressure ratio, is restricted by the maximum pre-ignition pressure and temperature that can be used and still prevent pre-ignition firing.

(e) The displacement of most engines is fixed. There have been recent attempts to decrease SFC by reducing displacement during operation. This has been done by deactivating the valves and switching off some cylinders. Unfortunately the cylinder cools, increasing wear and decreasing combustion efficiency when restarted. The system has not been commercially successful.

(f) Automotive engines in urban and suburban areas spend most of the time at half throttle or less, operating at 10 to 20 percent of maximum power output. Unfortunately total engine efficiency is sensitive to reductions in load. Current engines, which have their lowest SFC when fully loaded, operate most of the time lightly loaded, in their worst SFC region.

(g) Controlling engines by limiting produces a higher hydrocarbon content in the waste gas than does throttling. Specifically in the idle and lower partial load regions, as discussed in U.S. Pat. No. 4,765,288. Briefly, after valve closure, the charge expands to fill the full cylinder and then is recompressed into the clearance volume. This expansion cools the charge mixture, albeit only momentarily, until the charge is recompressed to the original volume that occured when the valve closed. The theory stated is that "the fuel cools relatively too much, the fuel evaporates poorly and as a result poor mixture preparation takes place" causing the higher hydrocarbon level. The proposed solution was to restrict the valve opening for an extended period of time. In effect, using the valve as a throttle, partially defeating one of the main purposes of limiting. The elimination of throttling losses.

(h) Controlling valve closure by hydraulic means is not new. One method is disclosed in U.S. Pat. No. 4,466,390. Valve operation occurs as a translating fluid plug, interposed between a camshaft and a valve, is collapsed and refilled. This system requires a hydraulic system with sufficient capacity and piping to rapidly refill the fluid plug, an electronic system to sense, compute, amplify and send a sufficiently powerful signal to actuate the fluid release valve each time the cylinder valve operates, and a fluid release valve that operates each time the cylinder valve operates. A complex and costly system.

(i) Supercharging is common practice since it produces more power from a smaller package. However, any practical potential for lowering SFC is due to increasing the mechanical efficiency, not to recovering additional work. Particularly so in engines that must operate over a wide range of conditions. The problem is that compression from the supercharger adds to the compression in the cylinder, and the total compression is still limited by the pre-ignition firing characteristics of the fuel. In the crossover speed ranges where the cylinder would have been filled without supercharging and yet there is substantial supercharging, the cylinder compression ratio must be kept low enough to avoid pre-ignition firing. At relatively lower speeds with little to no supercharger output, the total compression ratio is just the cylinder ratio. Thus at part load an engine of this type operates at a lower compression ratio, increasing the SFC for these operating conditions. Compensating for supercharger output by early intake valve closure was disclosed in Deutsche Patentschrift DT-PS 100 1049. It has been adapted to large diesels and gas engines, such as 2500 horsepower. These engines are primarily for steady state power production and as such are not suitable for automotive use. Indeed, the literature teaches that spark ignition engines do not need variable timing. Engines of this type have reduced pre-ignition temperatures and pressures at light loads, contributing to poor combustion. And, the lower pressures result in lower pressure ratios and lower cycle efficiency. The method is known, but the expense and complexity of the mechanical requirements to vary the valve timing further discourages commercial use in other than stationary or marine engines.

(k) In throttled engines the high vacuum that occurs during deceleration causes rapid evaporation of liquid fuel from the intake manifold walls. The resulting rich mixture increases exhaust emissions of carbon monoxide CO and hydrocarbons HC and also creates a potentially explosive vapor in the exhaust manifold if injected air is present.

(l) The high temperatures during the combustion process produces nitrous oxides $NO_x$. Large and expensive catlytic reactors are used to reduce the level of these emissions.

(m) The maximum torque from an engine occurs when the cylinders are fully charged or loaded and, when the compression ratio is at the maximum allowed to avoid pre-ignition firing. The addition of supercharging increases the mechanical efficiency and relatively lowers the expansion ratio. But, does not substantially increase the torque per unit displacement, since the effective displacement is increased by adding the supercharger. This is easier to see when considering a piston supercharger instead of a turbo-charger. The true displacement is that of the supercharger. Except for the effects of a slight increase in mechanical efficiency, torque per unit of true displacement is not increased.

OBJECTS AND ADVANTAGES

Accordingly, several objects and advantages of the present invention follow in respective order:

(a) To operate an IC engine at maximum prior art volumetric efficiency and have the capability to shift, within the same maximum displacement, to a more fuel efficient cycle.

(b) To decrease SFC by utilizing a greater expansion ratio cycle.

(c) To provide a commercially acceptable system to control engine output by varible intake valve closure, eliminating or substantially reducing throttling losses.

(d) To decrease SFC by increasing the pre-ignition pressure, or pressure ration with respect to atmospheric pressure, for part load operation.

(e) To provide a system that effectively reduces engine displacement without shutting off cylinders.

(f) To modify engine operation such that for part load operation the SFC is lower than for full load operation.

(g) To change the pre-ignition conditions when limiting to improve combustion and eliminate or substantially reduce the higher hydrocarbon level.

(h) To provide a reliable and relatively low cost hydro-mechanical valve arrangement, that reduces the hydraulic flow rate required to operate the valve and further, to provide a system that needs only passive control, either on or off, for steady state operation. No timed signal required for each valve cycle.

(I) To enable the feedback of supercharger compression work into the engine, replacing instead of adding to cylinder compression work.

(k) To reduce and possibly eliminate the CO and HC emissions that comes from the excessively rich mixture produced by high manifold vacuum during deceleration and idle.

(l) To reduce $NO_x$ emissions by increasing the burned gas mass fraction during combustion.

(m) To increase the torque per unit of true displacement by enabling supercharger compression to replace cylinder compression and maintaining or increasing the expansion ratio at part load.

Further objects and advantages of this invention can be seen in the description and operation section that follows.

DRAWING FIGURES

DESCRIPTION/OPERATION, DUAL COMPRESSION RATIO, FIG. 1

Figure 1:
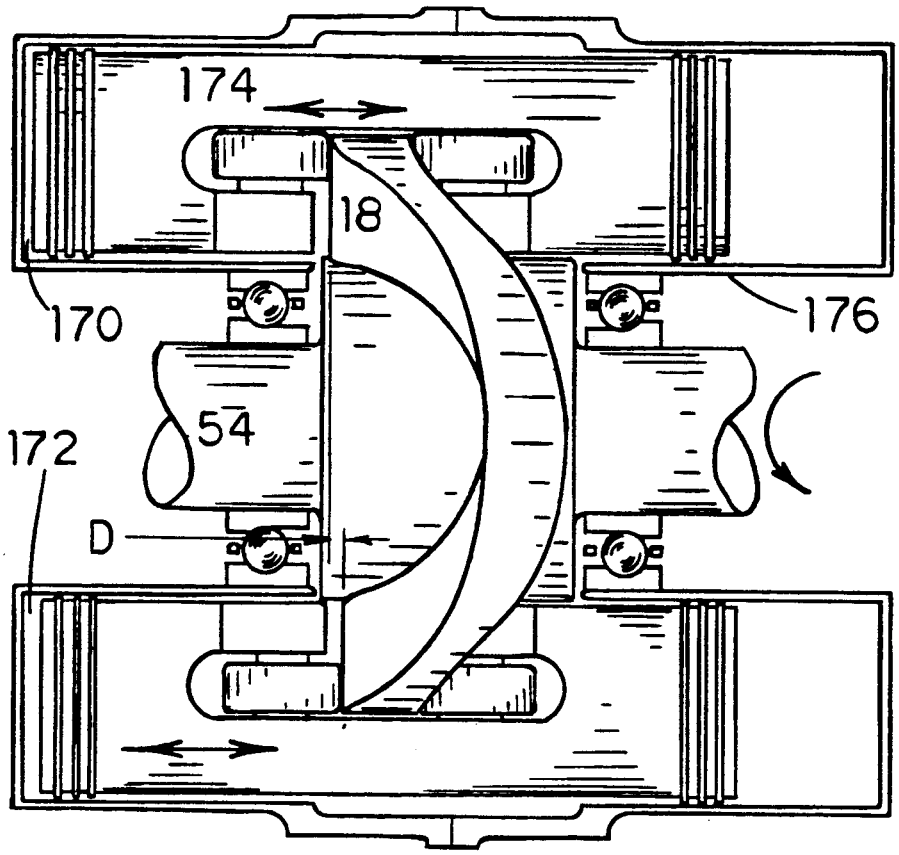
FIG. 1 is a simplified sectional view through the centerline of a dual compression ratio cam engine.

Description: A double sided piston drive cam 18 has a cam shape that undulates over the outer diameter of a drum shaped section of a main drive shaft 54. Cam 18, the drum section and shaft 54 form a rotor which is rotatably mounted in a cylinder block assembly 176. A number of rollerized double ended pistons 174 are spaced around the circumference of the rotor and each piston end is slidably engaged within the respective cylinders. The rollers are rotatably mounted in piston 174 and rollably engaged with cam 18 such that the axial position of piston 174 is determined by cam 18. Cam 18 has two maximal positions in each axial direction that differ by a dimension D.

Operation: Pistons 174 drive and are driven back and forth by rotating cam 18, in the manner of IC cam engines. The difference being that the two maximal positions, respective to each piston end on cam 18, produce two different piston up positions. An upper top dead center position called UTDC and a lower top dead center position called LTDC. The rotation of shaft 54 thereby produces a periodic succession of clearance volumes for each piston end. The smaller clearance volume 170 at UTDC produces a higher compression ratio. The larger clearance volume 172 at LTDC produces a lower compression ratio.

Figure 2:
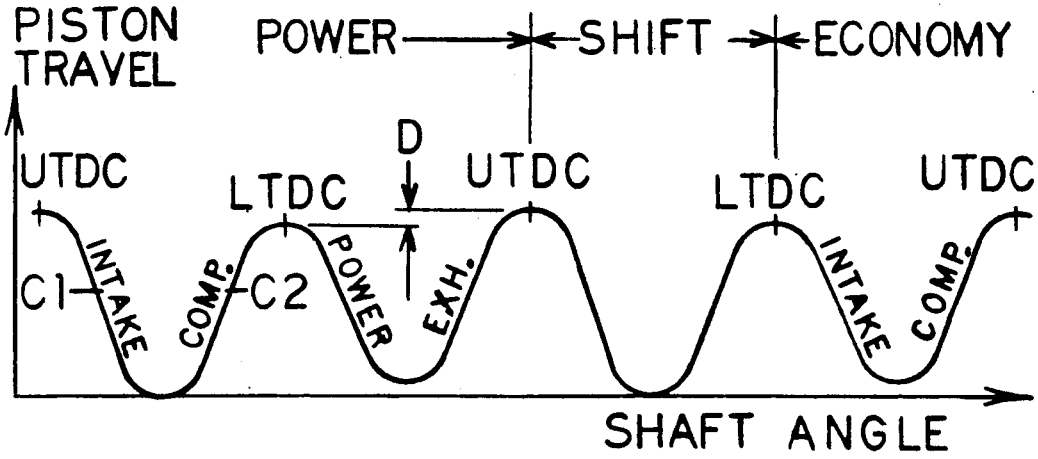
FIG. 2 is a graph of the four IC engine strokes superimposed on piston travel with respect to main shaft angle, before, during and after the shift.

The periodic succession of maximal and minimal chamber volumes can be seen in FIG. 2, wherein the strokes of a four stroke engine, intake, compression, power or expansion, and exhaust, are designated on the piston travel predetermined by cam 18. The strokes are divided into a power section where the engine operates similar to prior art fashion, an economy section where the engine operates more efficiently at the higher compression ratio, and a shift section illustrating the two stroke or 180 degree shaft angle shift required to go from one to the other, in a manner to be explained later.

Before the shift, power operation: Ignition occurs at LTDC, at the relatively lower compression ratio and at the larger clearance volume. The after-exhaust clearance volume is then the smaller clearance volume, yielding a smaller residual gas fraction. The compression and expansion ratios are equal. Unlimited filling of the cylinder with fuel air charge is permitted. Under these conditions the engine can produce maximum power. They are also the conditions at which the maximum compression ratio appropriate to design considerations is set.

During the shift: The relationship of piston travel to strokes is shifted two strokes. This corresponds to 180 degrees of main drive shaft rotation for a four stroke piston drive cam. The ignition or combustion point is shifted from LTDC to UTDC or, the reverse when shifting the opposite direction. Valve operation may be deactivated during the shift, depending on considerations such as valve to piston interference, backfire, etc.. More sophisticated systems could close the valves in each cylinder late in the exhaust stroke and re-activate operation during the new exhaust stroke, for a smoother shift.

After the shift, economy operation: Ignition occurs at UTDC, at a higher compression ratio and at the smaller clearance volume. The after exhaust clearance volume is the larger clearance volume, yielding a larger residual gas fraction. But, the maximum compression ratio was set for conditions before the shift, with the cylinder operating in power mode. This requires that the maximum charge be limited, either by throttling to limit the charge density, or limiting to limit the charge volume by early or late intake valve closure, or both. By throttling or varying the charge density, wide open throttle position is throttled back, the throttle opening reduced, so as to maintain a maximum intake manifold pressure. By limiting or varying the charge volume, the intake valve is closed either earlier or later to limit back the maximum intake volume. By both, each would be limited in accordance with the other and the total required. The net result of economy mode is the expansion ratio is increased to the total cylinder volume divided by the smaller clearance volume. And, the intake displacement is reduced, reducing the charge and the output of power. Further, the limited compression ratio is maintained at the reduced displacement.

In accordance with this invention limiting will be prefered to control the maximum charge. To the extent that limiting is used, throttling losses are eliminated and the relative increase in expansion ratios from power to economy is not pre-ignition firing limited.

Figure 3:
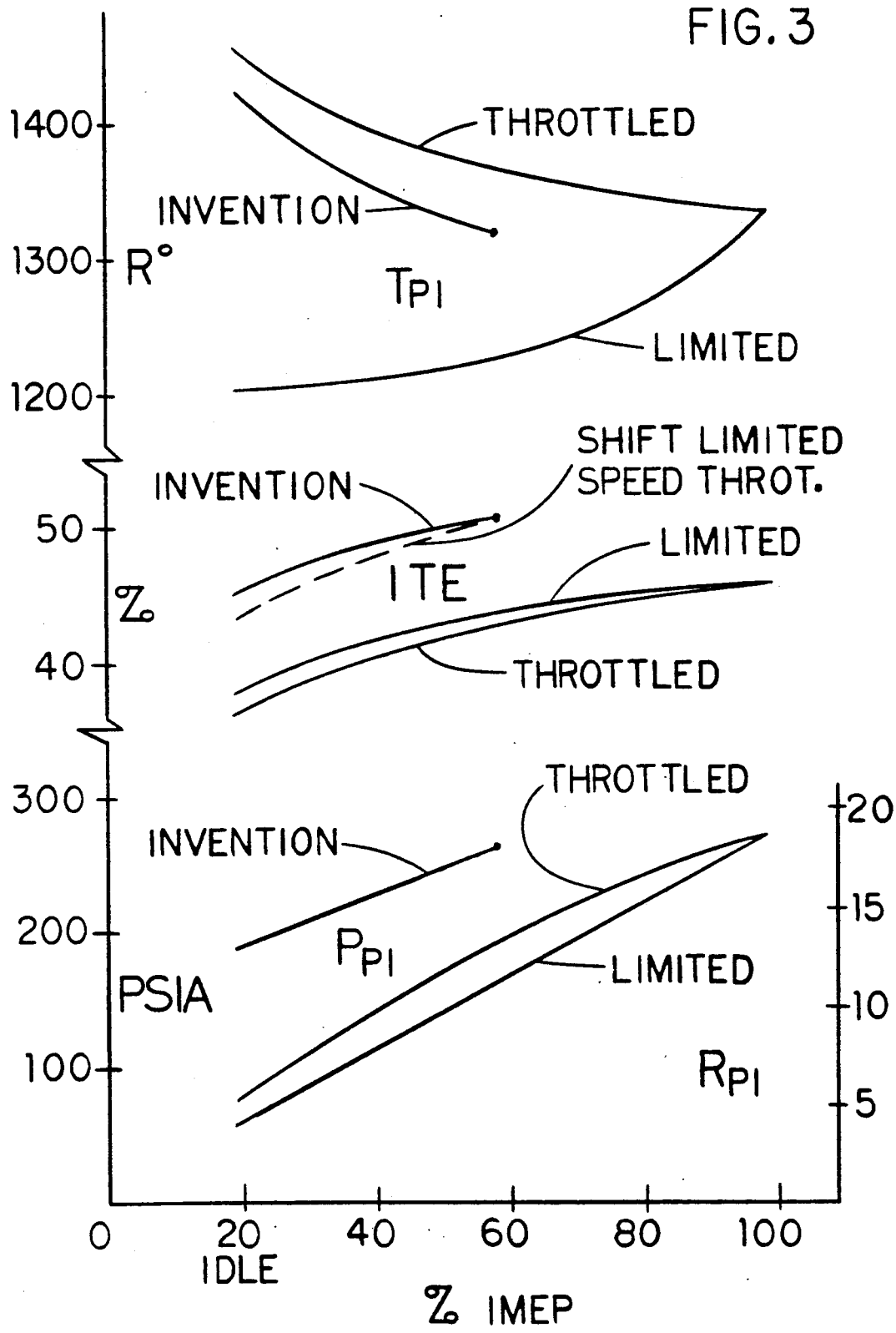
FIG. 3 is a graph of: pre-ignition pressure, $P_{pi}$ in psia; pre-ignition temperature, $T_{pi}$ in °R; pre-ignition pressure ratio, $R_{pi}$; and indicated thermal efficiency, ITE in %; all with respect to the percentage of maximum indicated mean effective pressure.

An advantage of maintaining the limited compression ratio is that the SFC is decreased by increasing the pre-ignition pressure, or the pre-ignition pressure ratio with respect to atmospheric pressure, for part load operation. The pre-ignition pressure, $P_{pi}$ in psia, shown on the left ordinate in FIG. 3, is plotted with respect to output shown on the abscissa. The plot also reflects the pressure ratio of pre-ignition to atmospheric pressure, $R_{pi}$, shown on the right ordinate. The output is expressed as the percentage of maximum indicated mean effective pressure, $\%_{imep}$. It can be seen that the invention pressure ratio is considerably higher than either the throttled or the limited ratio. This contributes to the similarly higher plot of indicated thermal efficiency, ITE in %, shown for the same conditions. The curves of FIG. 3 are plotted from calculations of the thermodynamic conditions for various operating modes in spark ignition engines. They are based on a compression ratio of 8.9 and an expansion ratio of 15. They are for idealized operation and have not been modified to include losses. As such, they are valid only for relative comparison.

A further advantage is apparent for part load operation when referring to FIG. 3. At 59 percent IMEP, this invention results in an increase in ITE of 21 percent. From 42 percent ITE, for an approximately equivalent IMEP under prior art or power operation, to 51 percent ITE for economy operation. The ITE of 51 percent is not only improved over the 42 percent at the equivalent output for power operation, it exceeds the ITE of 46 percent at full load. In other words, this invention engine at part load is more fuel efficient than at full load. The reverse of prior art.

DESCRIPTION/OPERATION, FIG. 4

Embodiment, variable limiting: A rollerized cam follower 24, including a roller 20 rotatably mounted on a roller shaft 22 fixedly attached to follower 24, constructed in the form of a piston, slidable within release controller 36, is in rolling contact with valve cam 58 at intake cam face 62. Valve cam 58 typically contains an exhaust cam face 74. Cam follower 24 is hollow to accept a compression spring 28 and a portion of a fluid plug 25 and slidably engage valve lifter 50. Further, at one axial location along cam follower 24 is a radial conduit and an annulus 26, connecting the inside of cam follower 24 with the inside of release controller 36. Controller 36 in the form of a hollow cylinder is slidably engaged with a limiter housing 52. Controller 36 has a controller annulus 30 connected to a return conduit 35 through a drain conduit 60 and a drain chamber 56. Controller 36 is pivotally connected to a controller drive link 32 by a link pin 34. A valve lifter 50 in the form of a stepped cylinder hollow at both ends has one end slidably engaged with both housing 52 and follower 24. Lifter 50 is hollow towards the follower end to accept spring 28 and a portion of fluid plug 25. Fluid plug 25 is connected by a radial conduit with a supply annulus 43 on lifter 50 and a supply conduit 44. Supply conduit 44 is connected to supply 38 through check valve 42 and supply pump 40. The hollow end of lifter 50, connected with an intake valve 48 through a spacer 46, is slidably engaged with housing 52. A valve spring 49 maintains closing force on valve 48. A step 51 between the outer diameters of lifter 50 abuts a step in limiter housing 52. A bypass conduit 41 connects with supply conduit 44. Conduit 41 returns hydraulic fluid through cutoff valve 45 and pressure relief valve 47 to supply 38. A limiting actuator, schematically represented by encircled letters LA, is to move link 32 and controlling the limiting and hence the speed. In the simplest case, it would represent a linkage system connecting link 32 to the accelerator pedal. In more sophisticated systems, it could represent electro-pneumatic or electro-hydraulic pistons, operated by the central control system described later.

Embodiment, differential shifting: Valve cam 58 is rotatably engaged between a main drive shaft 54 and a thrust bearing 64 and is in contact with a roller 20 at intake cam face 62. A bevel gear 68 meshes with a gear on valve cam 58 and a cam drive gear 66 fixedly attached to shaft 54. Gear 68 is rotatably mounted in a gear ring 72 on a bevel gear shaft 76. Ring 72 is rotatably mounted between drive gear 66 and bearing 64 and is pivotally pinned to a gear ring drive link 70. A shifting actuator is schematically represented by circled letters SA, to move link 70 and thereby shift between economy and power modes. Any number of known apparatus can be used to accomplish this, hydraulic or pneumatic pistons, shift levers, etc.

Operation, variable limiting: Pressurized hydraulic fluid is introduced through check valve 42 and conduit 44, completely filling the closed chamber that forms fluid plug 25 and interconnections thereto. Rotation of disk cam 58 drives cam follower 24, with periodic forces produced by the cam, through excursion path 78 of FIG. 5. Movement of follower 24 will be transmitted through the enclosed fluid to lifter 50, opening or closing valve 48. This movement will bring follower annulus 26 to overlap, or partially align with, controller annulus 30, completing a flowpath from plug 25 to return conduit 35. When this overlap occurs, the fluid in fluid plug 25 can escape and lifter 50 is free to drop. Once the overlap occurs it must be maintained until lifter 50 has returned to quiescent position. Spring 49 drives or biases valve 48 and lifter 50 to closed position. Follower 24 may still be moving towards the lifter but, will meet little resistance since fluid plug 25 is released.

Uncushioned descent of valve 48 would result in undesirable impact with the valve seat upon closure. The chamber formed between step 51 and the corresponding step on housing 52 will fill with hydraulic fluid as lifter 50 opens valve 48. As the valve closes, lifter 50 descends and fluid between the steps is forced through annulus 43 into fluid plug 25. When annulus 43 is closed off from the step chamber, a hydraulic cushion is formed. The diameters between step 51 and annulus 43 can be modified or shaped, limiting leakage to control the resistance of the cushion. The valve clearance, with lifter 50 and intake valve 48 in the closed position, is set by varying thicknesses of spacer 46.

Figure 5:
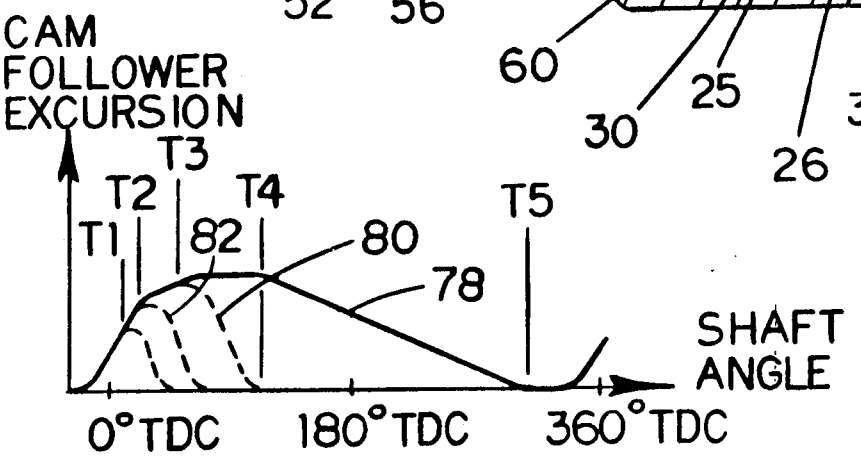
FIG. 5 is a graph of cam follower and valve lifter excursion paths with respect to main shaft angle, for the systems in FIGS. 4 and 8.

Follower 24 reaches the extreme up position on curve 78 at about T3 in FIG. 5. Plug 25 is released and lifter 50 descends along curve 80. In prior art, curve 80 would also correspond to cam follower travel which is slaved to the cam drivetrain and would be built into the cam profile and, follower 24 would descend in the relatively short time period from T3 to T4. Supply pump 40 would need to be of sufficient size to refill fluid plug 25 during the T3 to T4 time period. The fluid pressure on follower 24 combined with the force from spring 28 must be sufficient to maintain follower 24 in contact with cam 58 during the descent. The pause in the extreme up position of follower 24, between T3 and T4 on curve 78 in FIG. 5, allows lifter 50 to descend to closed position. In the closed position supply annulus 43 in lifter 50 overlaps supply conduit 44 and fluid plug 25 can be refilled. If this were not the case, hydraulic fluid would flow continuously from the supply once the fluid had been released.

It is one feature of this invention that the descent of follower 24 has a prolonged duration such that it takes place in an extended time period from T4 to T5. Slowing the descent to roughly one fourth of the rate from T3 to T4. The extended descent of follower 24 requires that the descent of lifter 50 always occurs due to release of fluid plug 25 and not due to following the cam profile down, as in prior art. This means a smaller piping and pump 40 capacity than required by the prior art to maintain contact of follower 24 with cam 58.

The beginning of valve closure is determined when follower annulus 26 overlaps controller annulus 30. When annulus 30 is positioned the farthest from annulus 26, when annulus 26 is at quiescent or down position, it takes longer for them to move to overlap. Thus, valve 48 is open the longest duration and closure commences at time T3 in FIG. 2. Conversely, the shortest open duration occurs when annulus 30 is positioned closest to annulus 26 and closure commences at T1. The open time is determined by the relative quiescent positions of annulus 30 and annulus 26, which in turn is determined by the position of controller 36. Controller 36 can be positioned by moving drive link 32 with the limiting actuator LA. Valve closure can be selectively started for any intermediate time T2, from T1 to T3, producing lifter 50 descent along curve 82 in FIG. 5. Thus, the fuel air charge to the cylinder can be continuously and variably limited as it is by the throttle in a car. With a fuel saving difference: the throttling losses are eliminated.

Intake valve 48 can be deactivated to reduce active displacement or, to close the valves during stroke shift. For active valve operation, cutoff valve 45 remains closed and operation proceeds as described before. A signal from the engine control system opens valve 45. The signal could be an applied voltage if valve 45 is solenoid operated. Fluid plug 25 can now escape out conduit 41 through valve 45 and pressure relief valve 47, provided that the fluid pressure exceeds the relief valve setting. This pressure setting would have a minimum level to prevent excessive flow from supply pump 40 and a maximum level below the pressure needed to overcome valve spring 49 and open valve 48. Thus, when cutoff valve 45 is closed the intake valve is active and when valve 45 is open the intake valve 48 is deactivated.

The above system provides a reliable and relatively low cost hydro-mechanical limiting system, either for early or late intake valve closure. It needs only passive control for steady state operation. No timed signal is required for each valve cycle.

It is a further advantage of this invention, combining limiting with increased pre-ignition pressure, to improve combustion and eliminate or substantially reduce the higher hydrocarbon level. Limiting alone in prior art engines produces relatively higher hydrocarbon levels in the idle and lower partial load regions. A review of pre-ignition temperature $T_{pi}$ and pressure $P_{pi}$ profiles in FIG. 3 offers an alternative theory, to that expressed in the referred U.S. Pat. No. 4,765,288. As the load is reduced in a throttled engine the pre-ignition temperature increases, whereas in a limited engine the temperature decreases. And, as the load is reduced, the pre-ignition pressure for both throttled and limited operation goes down, with limited going lower. At idle for limited operation, approximately 20 percent IMEP, where the maximum hydrocarbon production occurs, the absolute temperature is lower by 17 percent and the absolute pressure is lower by 25 percent. Either of these relative conditions can have a negative effect on the quality of combustion and hence contribute to higher hydrocarbon production.

In this invention, the pre-ignition pressure at idle and in the lower partial load regions is approximately twice that of either throttled or limited engines. And, the pre-ignition temperature at idle has been almost fully restored to throttled levels. Both changes are in the direction of decreasing hydrocarbon production and may even combine to reduce it below throttled levels.

A further advantage is to reduce and possibly eliminate the CO and HC emissions that comes from the excessively rich mixture produced by high manifold vacuum during deceleration and idle. This vacuum rapidly evaporates fuel condensed on the manifold walls. In a limited engine, there is no manifold vacuum. The manifold pressure is essentially constant at atmospheric pressure. No vacuum, no rich mixture.

Another advantage is to reduce $NO_x$ emissions by reducing their production during combustion: The residual gas, left in the cylinder from the previous cycle, acts as a diluent in the new unburned mixture. The absolute temperature reached after combustion varies inversely with the burned gas mass fraction. It is known that increasing this burned gas fraction reduces $NO_x$ emission levels substantially. In economy mode, where most engine operation will occur, and possibly all in an economy mode only engine, the exhaust clearance volume is larger than the combustion clearance volume. The larger volume leaves more unburned gas in the cylinder and would have the effect of decreasing the $NO_x$ emissions from the engine.

Operation, differential shifting: To shift the two strokes, or the required 180 degrees, the relationship of disk cam 58 to main drive shaft 54 must shift 180 degrees on a four stroke cam. If desired, the valves are then deactivated as previously described. Prior to the shift, gear ring 72 is stationary. Drive gear 66 rotates with drive shaft 54 and meshes with the bevel gear 68. Gear 68 meshes with disk cam 58, driving it in the opposite direction. The pitch diameters of the gear on cam 58 and drive gear 66 are equal. Therefore, as shift actuator SA moves link 70, driving gear ring 72 circumferentially through 90 degrees, the relationship between disk cam 58 and drive shaft 54 is shifted the required 180 degrees. The valves are reactivated and the shift is complete. The exhaust valves in prior art engines have their cam profiles on the same disk cam but in a different location. This is the case here and as intake valve cam face 62 is shifted, exhaust valve cam face 74 is also shifted. The same exhaust profile can be used since the exhaust valve need not be limited, although it is possible for timing variation. Another object can be achieved by modulating the two quiescent positions of gear ring 72 with shift actuator SA. Specifically, the timing for both the intake and exhaust valves can be advanced or retarded the same amount together.

DESCRIPTION/OPERATION, DUAL LOBE EMBODIMENT, FIG. 6

Embodiment, limiting and shifting: A rollerized cam follower 24B is in rolling contact with a valve cam 58B on one end and, slidably engaged with a valve lifter 50B and a limiter housing 52B on the other. Both lifter 50B and follower 24B are hollow and with housing 52B form a fluid chamber 120B between, which contains compression spring 28B. Chamber 120B is connected to a supply conduit 44B, through a follower conduit 144, which also connects to release conduit 142. A rotary valve 132 is rotatably and slidably engaged with housing 52B and rotatably only with a rotary valve slider 138. A shifting actuator, represented by encircled letters SA-B, can move rotary valve slider 138 and thereby shift between economy and power modes. As in FIG. 4, this actuator can take any number of known forms. Rotary valve 132 has an economy release port 136 shown and a power release port 137 not shown that is at axial location 139 on the interface with housing 52B. Between the axial locations of release ports 137 and 136 is a cutoff annulus 150, connected through a cutoff conduit 152 with chamber 146. A baffle 134 is affixed to valve 132 forming fluid chamber 146. A drain conduit 148 connects chamber 146 with the large drained chamber that contains the valves. Rotary slider 138 is slidably engaged with housing 52B and has two or more positions. Rotary valve 132 is slidably engaged with main drive shaft 54B. Shaft 54B is affixed to valve cam 58B. The opening of conduit 148 is placed circumferentially distant from ports 136 and 137, creating an elongated bubble free flowpath for released or returning fluid.

Figures 6, 7:
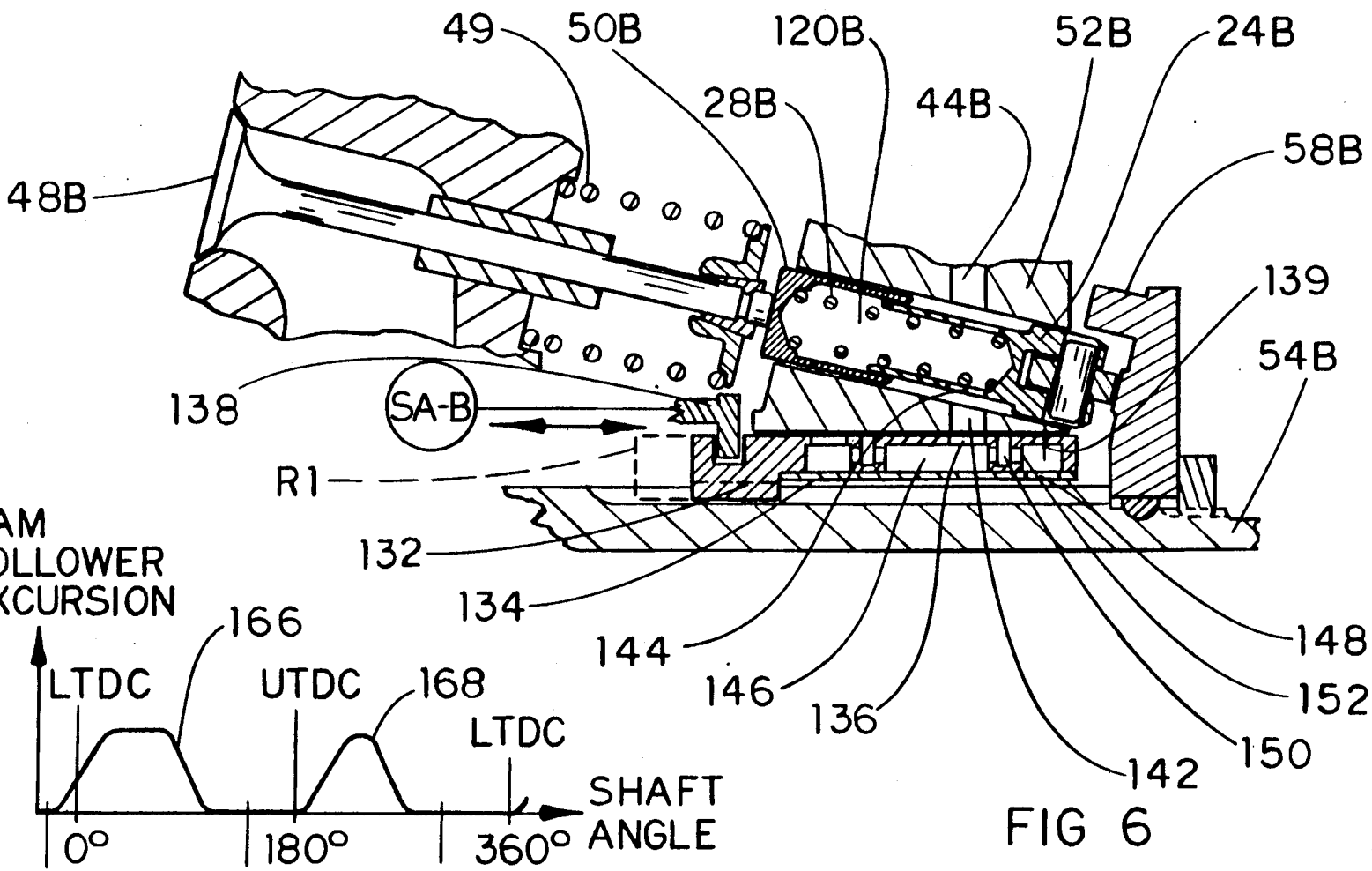
FIG. 6 is the same as FIG. 4, except showing a dual lobe valve cam system.
FIG. 7 is a graph of cam follower excursion paths, with respect to shaft angle, for the system in FIG. 6.

Operation, limiting and shifting: FIG. 7 graphs the excursion path of cam follower 24B driven by cam 58B, with respect to main shaft 54B rotation. Cam 58B has two lobes that produce the two excursion path shown: a power lobe 166 for power operation, normally aspirated; and an economy lobe 168 for economy operation, limiting the charge. In accordance with this invention lifter 50B is active for one lobe and inactive for the other, thereby selecting lobes 180 apart. This is accomplished through the rotation of rotary valve 132, alternately connecting and disconnecting conduit 142 with whichever release port, 136 or 137, is in the same axial plane.

Figure 4:
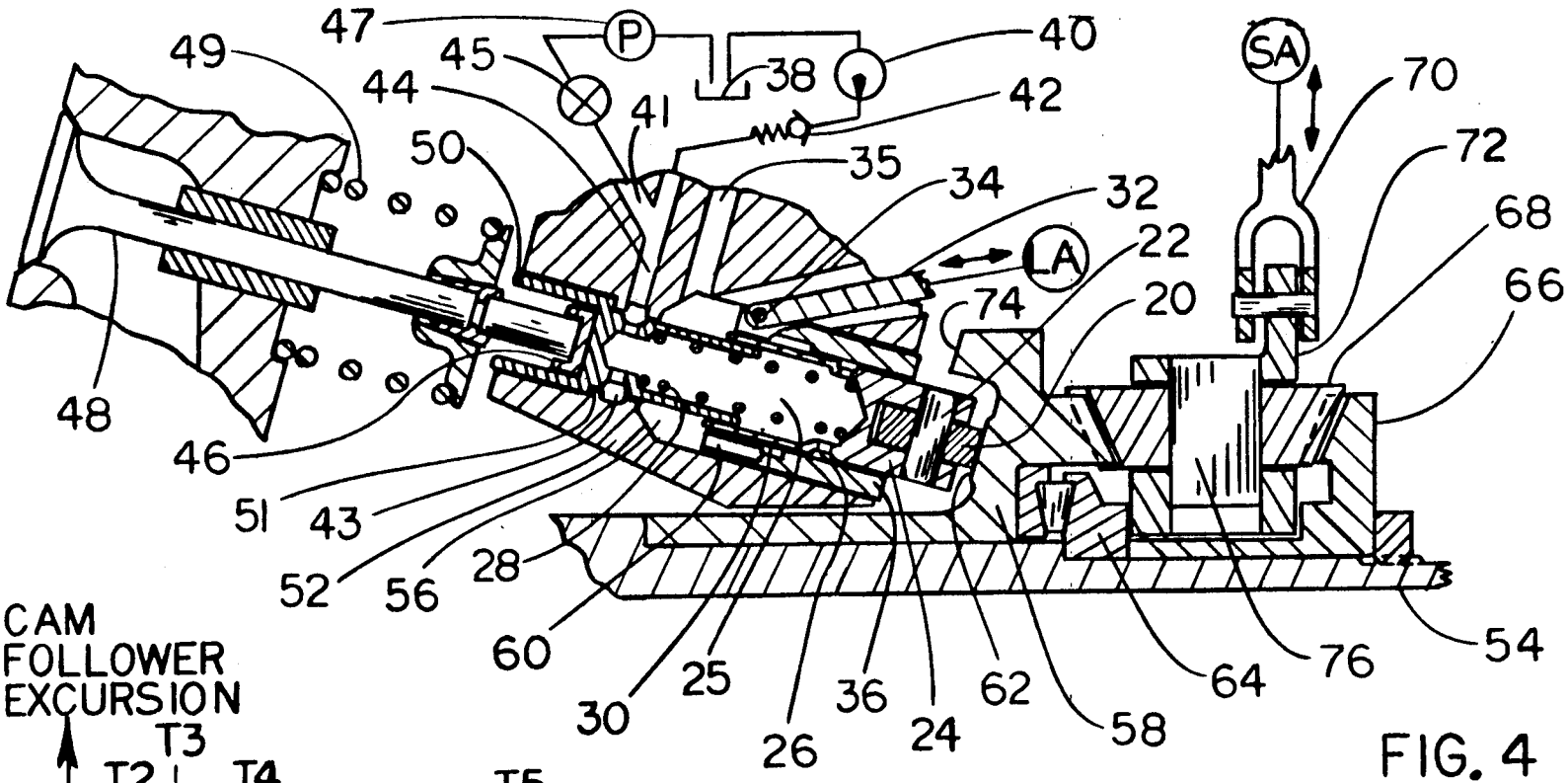
FIG. 4 is a fragmentary cross-sectional view through the centerline of an internal combustion cam engine, a differential style stroke shifting system and, a continuously variable valve limiting system.

Chambers 146, 120B and conduits 142, 144, 148 and 152 are supplied with hydraulic fluid through supply conduit 44B as in FIG. 4. Fluid pressure and force from spring 28B maintain both follower 24B in contact with cam 58B and lifter 50B in contact with valve 48. Main shaft 54B rotates rotary valve 132 relative to stationary housing 52B.

For economy operation the axial position of economy release port 136 is the same as conduit 142 and, port 137 is out of position and inactive. During the period from T6 to T7 in FIG. 7, economy release port 136 will circumferentially overlap conduit 142, interconnecting chamber 120B to drain conduit 148. Fluid displaced by follower 24B, as it moves up power lobe 166, can escape through conduit 148. There is little or no fluid pressure on lifter 50B to overcome the force of valve spring 49, to open valve 48. As follower 24B moves down power lobe 166, chamber 120B can be partially refilled with fluid returning from chamber 146. The balance of fluid comes from supply conduit **44*b*. At T7, where port 136 has rotated and no longer overlaps conduit 142, the release path is blocked. After T7, when follower 24B moves up and down the economy lobe 168, the enclosed fluid moves lifter 50B along the same path. After T8 the release path is reconnected and the cycle begins again. To shift to power operation, the shift actuator SA-B moves rotary valve slider 138 to position R1. This position R1 is the axial position where power release port 137 is in the same axial plane with conduit 142. Port 136 is now out of position and inactive. Power operation is the same as economy except, port 137 is the active port activating the power lobe 166 and deactivating the economy lobe 168**.

Chamber 146 and baffle 134 form an elongated flowpath from release ports 136 and 137 to conduit 148 for escaping fluid. This escaping fluid forms a radially pressurized reservoir that suppliments the refilling flow from conduit 44B into chamber 120. The pressure is supplied by the centripetal force that forces any overflow radially inward to drain conduit 148.

As the rotary valve 132 shifts between economy and power position, an intermediate position is passed when cutoff annulus 150 is axially aligned with release conduit 142. At this position conduit 142 always overlaps annulus 150, allowing fluid to escape through drain conduit 148. This deactivates valve 48 and any other valves so aligned. The intermediate position is used, if desired, to deactivate valve 48 during the shifts between economy and power position. It also may be used to deactivate all the valves on the same end of a double ended cam engine to reduce displacement. Using this dual lobe arrangement, the exhaust valves would also have dual lobes and operate or shift in the same manner as the intake valve. This is the reason for the second cutoff annulus and set of release ports shown on the shift actuator end of rotary valve 132. When the intake valve shifts to the other lobe 180 degrees away, the exhaust valve must also shift.

DESCRIPTION/OPERATION, INCREMENTAL EMBODIMENT, FIG. 8 AND 9

Embodiment, incremental limiting: A rollerized cam follower 24A is: constructed in the form of a piston on the end of a smaller shaft, slidable within a limiter housing 52A. Follower 24A is maintained in contact with a valve cam 58A, by a compression spring 28A and pressure from hydraulic fluid in a chamber 120. A release adjuster 118, constructed in the form of a piston, is adjustably affixed to follower 24A. The other end of spring 28A is in contact with housing 52A. A valve lifter 50A is: constructed in the form of a piston on the end of a smaller shaft, slidable within housing 52A and a cushion adjuster 100, partially exposed to fluid in chamber 120 and, maintained by fluid pressure in contact with valve 48. Valve 48 is springably loaded towards the closed position by valve spring 49. A cushion chamber 101 is formed between lifter 50A and adjuster 100. Hydraulic fluid is supplied in the same manner as in FIG. 4, through supply conduit 44A. Cushion adjuster 100 has an internal cushion annulus 106 connected through a conduit to chamber 120 and is adjustably affixed to housing 52A. Release adjuster 118 has a release face 108 on the chamber 120 end. Limiter housing 52A has two or more annulii on the interface with release adjuster 118, a power annulus 102 connected to a return conduit 35A and, an intermediate annulus 104 connected through a release valve 122 to drain. The axis of lifter 50 in this embodiment is shown behind spring 28A and follower 24A and, all are exposed to the fluid in chamber 120.

Figure 9:
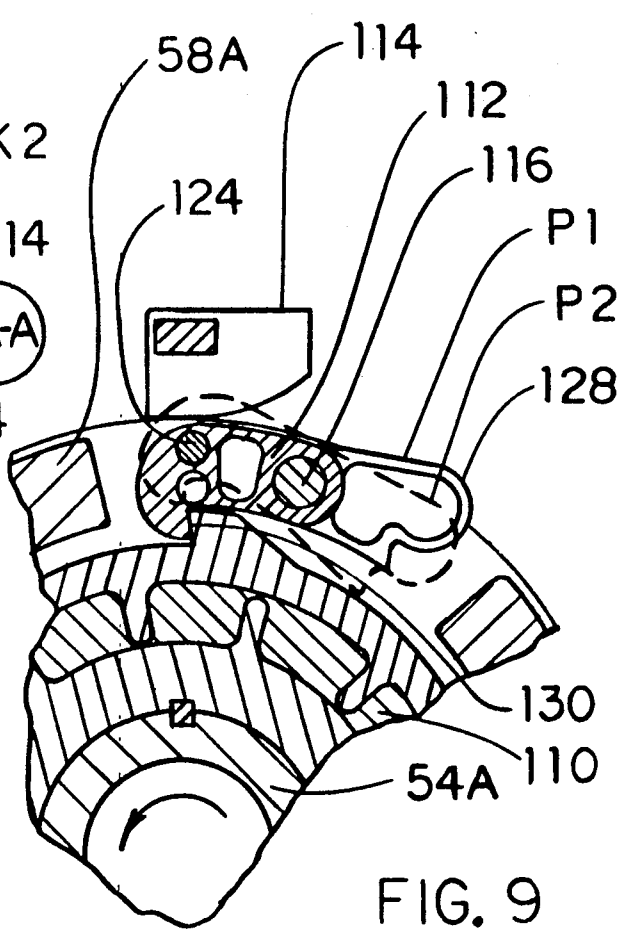
FIG. 9 is a sectional view A—A from FIG. 8, showing the trip mechanism.

Embodiment, trip shifting: Valve cam 58A is rotatably engaged between a main drive shaft 54A and a bearing 64A and is contacted by rollerized cam follower 24A. A trip lever 112 is rotatably mounted on a shaft 116 which is fixedly attached to cam 58A and has two positions of engagement, P1 and P2, with a trip key 114, a stop ring 110 and a detent pin 124. Stop ring 110 is an assembly of an inner ring and an outer ring fixedly attached together through a shock absorbing material, such as molded rubber. Trip key 114 has two positions of slidable engagement in a stationary housing, K1 and K2. Trip lever 112 has two positions determined by detent pin 124 which is held into a detent in lever 112 by the force of detent spring 126. Trip lever 112 also has a tab 128 that projects into the position of trip key 114 during rotation if, trip key 114 is in position K2. Stop ring 110 is fixedly attached to shaft 54A and engages stop face 130 on lever 112 so as to drive cam **58*a*. A shifting actuator is schematically represented by the encircled letters SA-A, to move trip key 112 and thereby shift between economy and power modes. Any number of known apparatus can perform this function, the same as the actuator in FIG. 4. FIG. 9** shows a sectional view of the trip lever, to clarify and to show the two positions.

Operation, incremental limiting: Functional operation is the same as FIG. 4 except lifter 50A and follower 24A axes are not coincident and the limiting is not continously variable, occuring only at fixed positions. As follower 24A is driven through the excursion path in FIG. 2, fluid is displaced in closed chamber 120. The incompressible displaced fluid raises lifter 50A accordingly. Lifter 50A motion continues until release face 108 exposes or overlaps the intermediate annulus 104 to chamber 120. If valve 122 is open the fluid is released and lifter 50A is driven down by the force of valve spring 49, closing valve 48. If release valve 122 is closed, nothing changes and follower 24A continues until face 108 exposes or overlaps the power annulus 102. Annulus 102 is always connected to return conduit 35A, releasing the fluid to close valve 48, so that the protracted refill may be used. Depending on the distance required between annulus 102 and annulus 104, opposing segments of annulii could be used to stagger them closely. Release valve 122 is passive except when changing operating modes. Either open for economy or closed for power mode. A hydraulic cushion is formed in chamber 101 when the shaft of lifter 50A penetrates adjuster 100 far enough to close off annulus 106. Variations in manufacturing tolerances or strength of cushion can be compensated for by moving adjuster 100 relative to housing 52A. Release adjuster 118 can also be adjusted relative to follower 24A to compensate for manufacturing tolerances so as to assure valve 48 closure at the proper time.

The addition of another annulus and valve, similar to annulus 104 and valve 122, offers other levels of limiting. Another similar annulus and valve, located overlapping the quiescent position of the large face on follower 24A, could be used to retard the opening of a valve until the overlap is closed. And yet another annulus, always connected to a return conduit, located to just overlap the maximum desired open position of the large face of lifter 50A, could be used to limit the maximum opening of valve 48.

Since continously variable speed control is required, a throttling system would be used as in the prior art. During power operation, the ITE would follow the throttled profile in FIG. 3. During economy operation, the ITE would peak at the same point as the invention profile but, throttle down from there along the dashed line shown.

Operation, trip shifting: Prior to the shift, stop ring 110 is engaged with trip lever 112, shown in position P1, driving valve cam 58A with main drive shaft 54A. As lever 112 is moved past the stationary trip key 114 in position K1 shown, no interaction occurs. Detent pin 124, forced into the detent in lever 112 by detent spring 126, holds lever 112 in position. Shifting 180 degrees, between economy and power position, is accomplished by shift actuator SA-A moving key 114 to position K2, shown in dashed lines. As lever 112 rotates past key 114, key 114 will now strike tab 128, rotating lever 112 on shaft 116 to the other detent position P2, shown in dashed lines in FIG. 9. This momentarily disconnects cam 58A from shaft 54A. Undriven cam 58A will slow until stop face 130 on lever 112 engages the opposite stop on ring 110. The shock absorbing material in stop ring 110 will absorb the impact. Cam 58A will continue to rotate with shaft 54A except, the relative positions have changed 180 degrees, shifting between economy and power modes. The shift is complete. Returning the position of trip key 114 to K1 would cause it to stroke the leading edge of trip lever 112, rotating it to position P1. Stop ring 110 would re-engage trip lever 112 restoring the former mode.

SUPERCHARGING

A synergistic effect occurs when limiting is used to control the output of a supercharged engine. Controlling the charge by limiting directly controls the operating compression ratio. In FIG. 2, at C1 the pressure and temperature conditions when the valve closes on the intake stroke are nominally restored at the same piston position on the compression stroke, at C2. The volume at C2 equals the volume at C1 and, is essentially unthrottled or at atmospheric pressure. As limiting varies this volume the operating compression ratio is proportionately varied.

Any reduction in compression ratio caused by supercharging is not necessary when limiting is used, if two more elements are added. First, the supercharging pressure must be sensed, or computed based on known engine characteristics. Second, the maximum limiter position reduced, or limited back, in accordance with the supercharger pressure. Otherwise, stepping on the accellerator would result in pre-ignition firing. The combined compression ratio would always equals the combination of the full supercharging compression ratio and an appropriately reduced operating compression ratio. The supercharger compression is always fully utilized and the cylinder compression adjusted. The result, as the engine accelerates into the supercharged speeds, is that the blowdown work recovered by the supercharger is now fed back into the engine. This work replaces compression work previously done by the piston, and thus adds directly to shaft output. This increases the torque per unit displacement and decreases SFC by more than the separate effects of prior art supercharging plus limiting, the first synergistic effect. According to Zinner in Supercharging of IC Engines the increase in output can be from 25 to 40 percent. The higher compression from supercharging can replace cylinder compression, or the net work could be used to increase the capacity of the compressor and supply compressed fluid for other uses.

It should be noted at this point, that the feedback advantages of this invention apply to all displacement type, or expansible chamber, engines that can have their maximum charges throttled back or limited back: internal combustion, external combustion, other forms of heating, compression ignition or spark ignition. The substantial work used for compression in a diesel engine could be partially replaced by work recovered from the exhaust.

DESCRIPTION/OPERATION, CONTROL SYSTEM, FIG. 10

A system to control the continously variable limiting arrangement in FIG. 4, is shown in FIG. 11. It is shown schematically and illustrates the controls relevant to this invention. In prior art and for this invention, this system would probably contain an electronic control unit or ECU in a control system 164, coupled with an array of mechanical, electrical, pneumatic and hydraulic devices for sending, receiving and actuating. The ECU would receive input signals from respective sensors, representative of engine speed or RPM, loading demand on the engine, for example derived from a potentiometer coupled to an accelerator pedal 154, supercharger speed and pressure, oil and water temperatures, etc.. The ECU would contain stored data, representative of engine operating characteristics relative to various variable input parameters, and provide appropriate output signals, such as selecting the appropriate clearance volume. And, changing the ignition or combustion timing in accordance with the selected clearance volume. These signals would control the shift actuator through a line 158, to put the engine in economy or power mode and deactivate the valves during shifting by opening the cutoff valve through a line 162. Depending on mode, the accelerator stop 156 would be positioned to avoid overcharging the cylinders. The speed control actuator would control engine speed through a line 160 by controlling the open duration of the intake valves.

The system to control the dual lobe arrangement in FIG. 6 would be the same as for FIG. 4 except: the speed control actuator would operate a throttle as in the prior art. The accelerator stop would be omitted since the limiting function is built into the two different lobe shapes on the valve cam.

Figure 8:
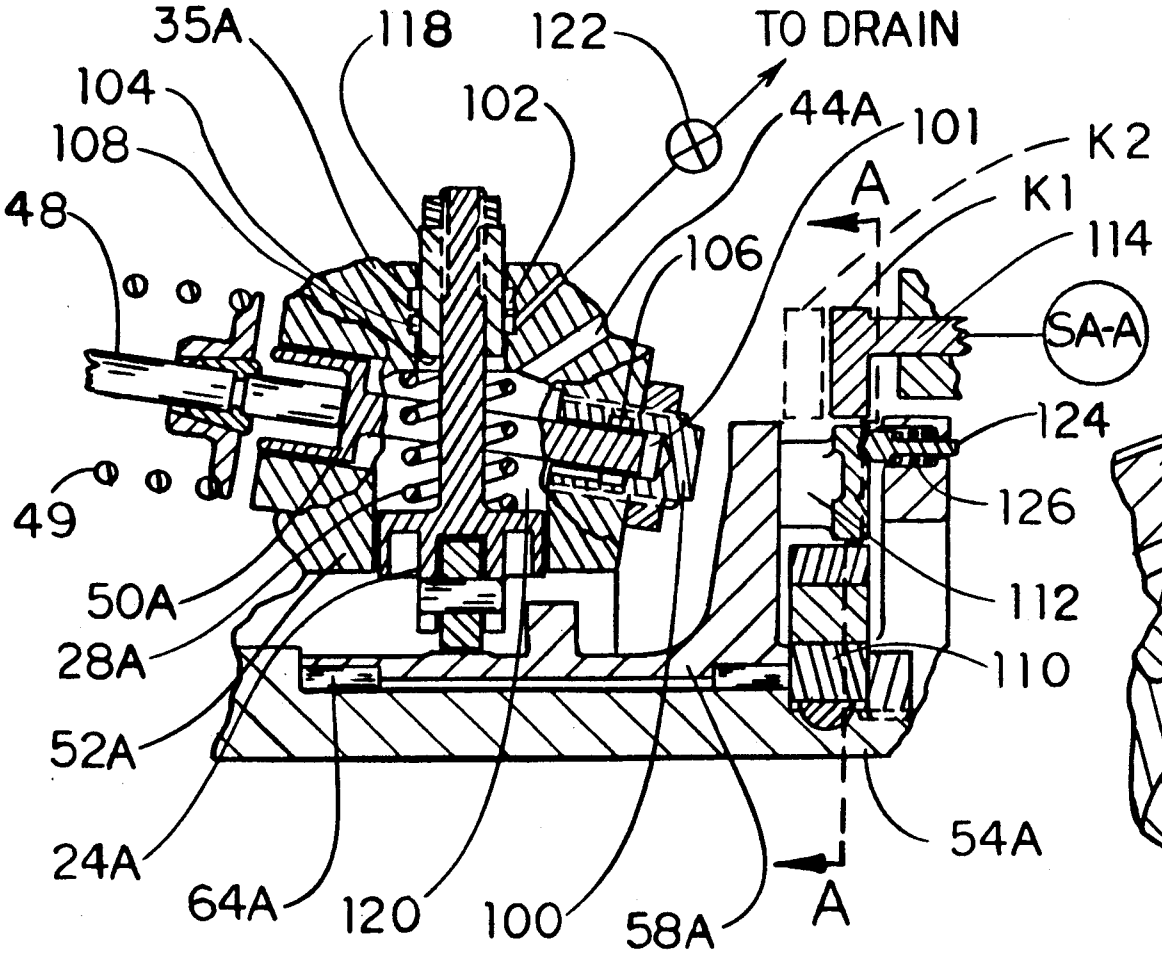
FIG. 8 is the same as FIG. 4, except showing an incrementally variable limiting and trip type shifting systems.
Figure 10:
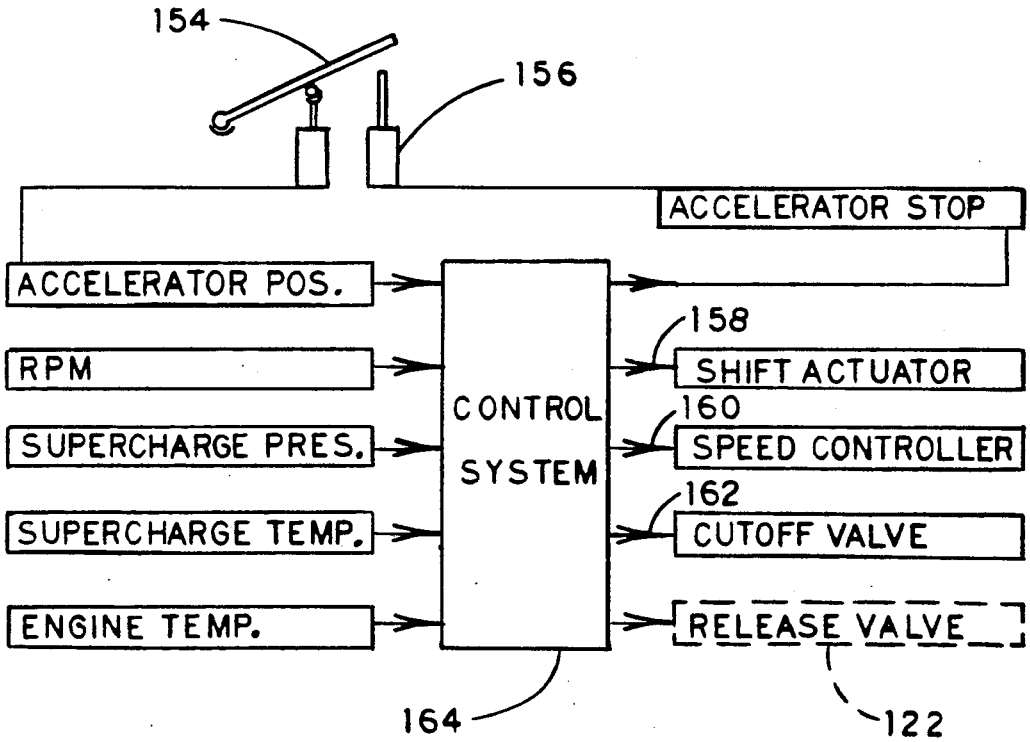
FIG. 10 is a schematic representation of an engine control system to operate the systems of FIGS. 1 and 4.

The system to control the arrangement in FIG. 8 would be the same as for FIG. 6 except accelerator stop 156 would be eliminated and the function of stop 156 accomplished by release valve 122, shown in dashed lines. Additional release valve positions, with different levels of limiting, could be optionally provided for supercharged compression compensation or work feedback, etc..

SUMMARY

A combination of interrelating effects produces the substantial increase in efficiency, shown in part in FIG. 3. Variations in a piston drive cam profile produces a plurality of clearance volumes. Selectability of the firing clearance volume produces a choice of expansion ratios. Limiting the higher expansion ratio maintains the maximum compression ratio at a reduced intake displacement, enabling a higher indicated efficiency at part power. Extending the required limiting across the operating range enables speed control without throttling losses. Reducing wide open limiting enables the feedback of supercharger compression work into the engine. Many of these effects are applicable to any expansible chamber engine, defined as one that expands a chamber with pressurized fluid to produce a useable output.

The three valve control arrangements, FIGS. 4, 6 and 8, have in common limiting back, when in the highest compression ratio mode of a dual compression ratio engine. This is done so that the lower compression ratio can be set at the maximum compression ratio allowed to avoid pre-ignition firing. Producing maximum efficiency and output for a given displacement. The ability to shift during operation to the higher apparent compression ratio, concurrently with the required limiting back, enables the achievement of several long sought goals:

First, for part load operation, where virtually all vehicular engine operation occurs, the maximum allowable pre-ignition pressure ratio $R_{pi}$ is maintained. At least at the maximum load point in the economy or invention mode. This is shown in FIG. 3, where an $R_{pi}$ of 18 is maintained at the invention maximum and at maximum power, instead of dropping to an $R_{pi}$ of 13 as it would for the equivalent throttled engine. Hence, a higher indicated thermal efficiency, ITE.

Second, in all three embodiments, at the maximum load point in the economy mode the charge is limited back. No throttling losses when limiting back to full economy power, approximately 59 percent maximum power.

Third, in the economy mode the engine is operating in a greater expansion ratio cycle. Making the invention engine more fuel efficient at part load than at full load, reversing the prior art relationship.

Fourth, the shift to economy mode results in the equivalent of a displacement reduction without shutting off cylinders, improving operating conditions as well as efficiency.

Fifth, the reduction of variations in manifold vacuum that produces the rich mixture during deceleration and idle, the increasing of pre-ignition pressure and temperature at idle and in the lower partial load regions, and the increased burned gas mass fraction in economy mode where most operation occurs, together point towards a substantial reduction in HC, CO and $NO_x$ emissions.

There is another advantage that is apparent from a test performed by the writer. A vacuum guage was placed inside a 1981 Oldsmobile and connected to the intake manifold of the 307 engine. The car was driven through various city and suburban conditions using normal speed, acceleration and deceleration. The vacuum varied from 10 to 20 inches of mercury. The engine operated at all times at a power level that would fall within economy mode. The proverbial car driven by an old lady schoolteacher would never be shifted into power mode. In a practical sense, the power mode could be treated as a passing gear, with the bulk or even all of the operation occuring in the more fuel efficient and less emissive economy mode.

The three valve arrangements each have reasons to be considered the prefered embodiment:

FIG. 4 provides continously variable limiting and the potential for advancing or retarding the valve timing and, offers the most sophisticated control capabilities. Throttling and the associated losses are essentially eliminated since speed control is accomplished by limiting.

FIG. 8 is designed for speed control by throttling, with limiting used to limit back for the shift and further includes: the potential for other increments of limiting; a shorter overall engine length; an easier to manufacture radial cam profile; improved adjustability to control the effects of wear and manufacturing tolerances; and adaptability to splayed valves or valves radially oriented in a spherically radiused cylinder head, reducing the critical surface to volume ratio.

FIG. 7 has two modes of operation, power and economy, built into a two lobe cam profile. The main advantage is the mechanical simplicity, since shifting of the cam to shaft relationship is not required. Instead, the desired lobe is activated and the other deactivated, by valvably controlling the fluid plug.

All three valve arrangements are passively controlled for steady state operation. No input is required other than continued rotation of the cam. The rotary valve function in FIG. 3 could be done by other known types of on or off valves, serving only the less critically timed on and off functions during the quiescent periods of each valve cycle.

The combination of variable limiting with supercharging enables recovered exhaust work to be converted into additional engine output. The engine is limited to replace cylinder compression with supercharger compression. To the extent that limiting occurs, the engine performs as any other limited engine with the compression being performed by the supercharger and the expansion ratio remains essentially just the cylinder ratio. And, the pre-ignition pressure and temperature follow the limited curves of FIG. 3. In the lower partial load region, where lower pre-ignition pressures occur, and hence lower and less efficient overall pressure ratios, the resultant loss in cycle efficiency subtracts from the efficiency gained due to compensating for supercharging. The gain is essentially never any more than from limiting alone. The gains only exceed the losses when the further effects of reduced displacement plus greater expansion ratio are added. The combination together with a relatively simple control system, makes Miller Supercharging of an automotive engine practical. This can add roughly another 30 percent to the miles per gallon and 25 to 40 percent more output from a given displacement.

For example: Shifting from power to economy decreases the clearance volume; economy to power increases the clearance volume. In compression or spark ignited engines with comparable firing pressures and temperatures, the limiting factor for power is the size of the clearance volume. It ultimately determines how much of a given charge can be contained. Thus, shifting from a smaller clearance volume in a normally aspirated mode, to a larger clearance volume mode with the intake pressure boosted to maintain the same nominal firing conditions, the effective operating displacement and power will be increased in near proportion to the increase in clearance volume. Supercharging, to the extent that firing pressure and temperature can be increased, may then be added to both modes.

Many modifications and variations of the disclosed features of this invention are possible. For example: the variable release controller 36 of FIG. 4 can be adapted to the non-coincident follower 24A and lifter 50A axes design of FIG. 8, making a shorter engine or for better adjustability, etc.; any of the valve arrangements can be incorporated into spark or compression ignition engines of conventional in-line, V, or other designs. The double ended pistons of FIG. 1 could be single ended. An economy mode only engine is possible. The dual lobe cam could also be a single lobe rotating at twice speed. It is to be understood, therefore, that the invention can be practiced otherwise than as specifically described.

The bottom line for any invention, what it can achieve, is best stated for this invention in an automotive context. Using the road test results of the referred U.S. Pat. No. 4,280,451, where a 23 percent increase in MPG was measured, against a calculated increase in indicated thermal efficiency for the tested engine, and, calculating the increase in the same efficiency using the same method for the invention engine, excluding supercharging, the projected increase in MPG is 56 percent, without reducing the maximum power of the engine.

It will be apparent to anyone familiar with the prior art, that this is not just an improvement of existing art, but a fundamental change in the way an engine is operated. It is a pioneering invention representing a breakthrough in engine technology, in one of the most competitive and crowded fields. As such it deserves the broadest interpretation of the following claims as to the heart and the essence of this invention.

I claim:

1. An expansible chamber engine having at least one cylinder, said cylinder having a piston, said piston defining in part a clearance volume at top dead center, said clearance volume continously alternating between a maximum and a minimum clearance volume, said cylinder having a functional cycle following the piston top dead center position, said functional cycle being shiftable to follow each of the maximum and minimum clearance volumes.

2. The engine of claim 1, further including a valve, a valve cam, said valve cam being driven by a shaft, the rotation of said shaft being synchronous with the reciprocation of said piston, and wherein the means for shifting comprises:

drivetrain means effecting opening of said valve in response to a lobe on said valve cam, the angular position of said lobe being variable relative to said shaft whereby the timing for said valve is shiftable.

3. The engine of claim 2, wherein said valve cam includes a plurality of lobes, the timing of said lobes corresponding to the timing of said maximum and minimum clearance volumes, and wherein said drivetrain means includes means for selectively enabling and disabling the valve operation effected by each of said lobes whereby said angular position is variable.

4. The engine of claim 2, wherein the means for varying said angular position of said lobe comprises means for changing the angular relationship of said valve cam to said shaft, said engine further including means biasing said valve towards closure, a cam follower being axially displacable along a longitudinal axis, and an improvement comprising:

said cam follower having a path defining edge;

said edge coming into communication with an exit port thereby defining a flowpath; and the position of said exit port being variable along the length of said longitudinal axis whereby intake volume is controllable.

5. The engine of claim 4, wherein the means for varying said position of said exit port comprises: a first exit port, said first exit port having a valvable connection interposed between said first exit port and the outlet for said first exit port, a second exit port, and means for selectively opening and closing said valvable connection thereby shifting the effective position between said first and second exit ports.

6. The engine of claim 4, wherein the means for varying said position of said exit port comprises means for moving said exit port continously along said longitudinal axis.

7. The engine of claim 4, further including means for returning said cam follower to a quiescent position at a period of time after the latest time when said valve closes under normal operating conditions for said engine.

8. A hydraulic valve control system for an expansible chamber engine having a valve, said valve being biased towards closure, a valve cam, a cam follower being axially displaceable along a longitudinal axis, said cam follower having a path defining edge, said edge coming into communication with an exit port thereby defining a flowpath, the position of said exit port being variable along the length of said longitudinal axis.

9. The system of claim 8, wherein the means for varying said position of said exit port comprises: a first exit port, said first exit port having a valvable connection interposed between said first exit port and the outlet for said first exit port, a second exit port, and means for selectively opening and closing said valvable connection thereby shifting the effective position between said first and second exit ports.

10. The system of claim 8, wherein the means for varying said position of said exit port comprises means for moving said exit port continously along said longitudinal axis.

11. The engine of claim 8, further including means for returning said cam follower to a quiescent position at a period of time after the latest time when said valve closes under normal operating conditions for said engine.

12. A method of performing a functional cycle with a valve cam system for an expansible chamber engine having a valve, a cam follower following the valve cam, drivetrain means effecting opening of said valve in response to said valve cam, said drivetrain means including the step of closing said valve before the return of said cam follower to a quiescent position, and the further step of returning said cam follower to said quiescent position, at a period of time after the latest time when said valve closes under normal operating conditions for said engine.

13. A method of operating an expansible chamber engine having at least one cylinder, said cylinder having a piston, said piston defining in part a clearance volume at top dead center, said clearance volume being one of a continous series of clearance volumes, said cylinder having a functional cycle following the piston top dead center position, comprising the step of: shifting said functional cycle to follow a subsequent clearance volume.

14. The method of claim 13, operating in an engine further including a valve, a valve cam, said valve cam being driven by a shaft, the rotation of said shaft being synchronous with the reciprocation of said piston, said valve cam having a plurality of lobes, the timing of said lobes corresponding to the timing of said series of clearance volumes, and means for selectively enabling and disabling the valve operation effected by each of said lobes, wherein said shifting step comprises the steps of: disabling said valve operation effected by one of said lobes; and enabling said valve operation effected by a subsequent lobe.

15. The method of claim 13, operating in an engine wherein said series of clearance volumes continously alternates between a maximum and a minimum clearance volume, said engine further including means for varying the intake volume to said cylinder, wherein said shifting step further includes the step of: limiting said intake volume in accordance with the volume of said subsequent clearance volume.

16. The method of claim 15, operating in an engine further including a valve, a valve cam, said valve cam being driven by a shaft, the rotation of said shaft being synchronous with the reciprocation of said piston, drivetrain means effecting opening of said valve in response to a lobe on said valve cam, the angular position of said lobe being variable relative to said shaft, wherein said shifting step comprises the step of: shifting said angular position whereby the timing of said lobe corresponds to the timing of said subsequent clearance volume.

17. The method of claim 16, operating in an engine wherein said valve cam includes a plurality of lobes, the timing of said lobes corresponding to the timing of said maximum and minimum clearance volumes, and wherein said engine further including means for selectively enabling and disabling the valve operation effected by each of said lobes, wherein said shifting step comprises the steps of: disabling said valve operation effected by one of said lobes; and enabling said valve operation effected by a subsequent lobe.

18. The method of claim 16, operating in an engine wherein the means for varying said angular position of said lobe comprises means for changing the angular relationship of said valve cam to said shaft, said engine further including means biasing said valve towards closure, a cam follower being axially displacable along a longitudinal axis, said cam follower having a path defining edge, and said edge coming into communication with an exit port thereby defining a flowpath, wherein said steps of shifting said angular position and limiting said intake volume comprise the steps of:

changing said angular relationship of said valve cam to said shaft; and varying the position of said exit port along the length of said longitudinal axis.

19. The method of claim 18, operating in an engine further including a first exit port, said first exit port having a valvable connection interposed between said first exit port and the outlet for said first exit port, and a second exit port, wherein said step of varying said position of said exit port comprises the step of: selectively opening and closing said valvable connection thereby shifting the effective position between said first and second exit ports.

20. The method of claim 18, wherein said step of varying said position of said exit port comprises the step of moving said exit port continously along said longitudinal axis.

21. The method of claim 18, further including the step of returning said cam follower to a quiescent position at a period of time after the latest time when said valve closes under normal operating conditions for said engine.

* * * * *